US009591903B1

(12) United States Patent
Hsieh

(10) Patent No.: US 9,591,903 B1
(45) Date of Patent: Mar. 14, 2017

(54) ELECTRIC UMBRELLA HAVING ROLLER SETS

(71) Applicant: Ai-Hui Huang, Changhua Hsien (TW)

(72) Inventor: David Hsieh, Changhua Hsien (TW)

(73) Assignee: Ai-Hui Huang, Changhua Hsien (TW)

( * ) Notice: Subject to any disclaimer, the term of this patent is extended or adjusted under 35 U.S.C. 154(b) by 0 days.

(21) Appl. No.: 15/046,852

(22) Filed: Feb. 18, 2016

(51) Int. Cl.
*A45B 25/16* (2006.01)
*A45B 25/14* (2006.01)

(52) U.S. Cl.
CPC ..... *A45B 25/165* (2013.01); *A45B 25/143* (2013.01)

(58) Field of Classification Search
CPC ..... A45B 25/143; A45B 25/165
USPC ..... 135/20.3
See application file for complete search history.

(56) References Cited

U.S. PATENT DOCUMENTS 2,168,188 A * 8/1939 Bernhard ..... A45B 19/04 135/25.41
4,807,655 A * 2/1989 Robertson ..... A45B 23/00 135/20.3
5,291,908 A * 3/1994 Grady, II ..... A45B 25/165 135/20.3
5,803,102 A * 9/1998 Ko ..... A45B 25/143 135/22
6,112,755 A * 9/2000 Lin ..... A45B 19/04 135/20.3
6,145,522 A * 11/2000 Ko ..... A45B 25/16 135/24
6,170,497 B1 * 1/2001 Ma ..... A45B 25/14 135/15.1
8,087,420 B1 * 1/2012 Lukacsy ..... A45B 23/00 135/20.3
8,757,183 B2 * 6/2014 Volin ..... A45B 25/143 135/20.3
9,364,058 B1 * 6/2016 Hsieh ..... A45B 9/00
2004/0221884 A1 * 11/2004 Yang ..... A45B 25/06 135/24
2005/0247332 A1 * 11/2005 Hung ..... A45B 25/165 135/20.3
2011/0132416 A1 * 6/2011 Ko ..... A45B 25/143 135/20.3
2011/0315179 A1 * 12/2011 Glatz ..... A45B 19/04 135/98
2012/0266927 A1 * 10/2012 Lukacsy ..... A45B 23/00 135/20.3
2014/0373886 A1 * 12/2014 Ko ..... A45B 25/16 135/22

* cited by examiner

*Primary Examiner* — Robert Canfield

(57) ABSTRACT

An electric umbrella having roller sets contains: a first stick section, a second stick section, a third stick section, and a transmission mechanism. The second stick section is fitted in the third stick section, and the third stick section is fitted in the first stick section, a lower portion of the second stick section is in connection with a handle. The first stick section includes an upper runner disposed on a top including a first roller set disposed therein, and two ends of the driving rope are fixed on two sides of the lower runner, the driving rope rolls across the first roller set and slides between a top of the third stick section and the first roller set, and the transmission mechanism in the second stick section and drives the third stick section through a driving source in the handle drives the umbrella skeleton to expand or retract.

4 Claims, 2 Drawing Sheets

ELECTRIC UMBRELLA HAVING ROLLER SETS

FIELD OF THE INVENTION

The present invention relates to an umbrella, and more particularly to an electric umbrella having roller sets.

BACKGROUND OF THE INVENTION

When operating an umbrella manually, it is easy to injure user's hand, so a variety of electric umbrellas are developed with development of society.

For example, a conventional electric umbrella contains a transmission mechanism configured to drive the expansion and retraction of the electric umbrella, but this transmission mechanism is not strong and is disassembled inconveniently. Moreover, a plurality of toothed members are arranged on an upper side and a lower side of the transmission mechanism and engage with one another to drive the electric umbrella to expand and retract. However, a size of the plurality of toothed members is small and is produced precisely, so they get stuck easily and operate unstably. When one of the plurality of toothed members is broken, it is troublesome to inspect and maintain the plurality of toothed members. Another transmission mechanism contains at least one rack and pinion, but a support capability of a rack is insufficient that will damage the rack easily.

The present invention has arisen to mitigate and/or obviate the afore-described disadvantages.

SUMMARY OF THE INVENTION

The primary objective of the present invention is to provide an electric umbrella having roller sets which operates stably and avoids getting stuck.

To obtain the above objectives, an electric umbrella having roller sets provided by the present invention contains: a first stick section, a second stick section, a third stick section, and a transmission mechanism. The second stick section is fitted in the third stick section, and the third stick section is fitted in the first stick section, a lower portion of the second stick section is in connection with a handle.

The first stick section includes an upper runner disposed on a top thereof and includes a first roller set disposed therein, and two ends of the driving rope are fixed on two sides of the lower runner, respectively, the driving rope rolls across the first roller set and slides upwardly and downwardly between a top of the third stick section and the first roller set, the upper runner and the second runner are connected with an umbrella skeleton, a first end of a pull rope is secured on the handle, and a second end of the pull rope extends across a third roller on the top of the third stick section to join with the first stick section.

The transmission mechanism is accommodated in the second stick section and drives the third stick section.

A driving source is mounted in the handle to drive the transmission mechanism, and the transmission mechanism drives the umbrella skeleton to expand or retract.

Preferably, the driving rope divides into two parts on the top of the third stick section, and a free end of each part of the driving rope is in connection with the top of the third stick section.

Preferably, the third stick section has an fourth roller across which the driving rope rolls.

Thereby, the electric umbrella contains a plurality of roller sets and the driving rope by which the lower runner is pulled to slide upwardly and downwardly relative to the first stick section and the second stick section, thus expending or retracting the umbrella skeleton.

Preferably, the transmission mechanism contains the threaded rod and the screw nut so as to move the plurality of roller sets stably and to avoid getting stuck the plurality of roller sets, thus preventing damage and prolonging service life of the plurality of roller sets.

DETAILED DESCRIPTION OF THE PREFERRED EMBODIMENTS

Figure 1:
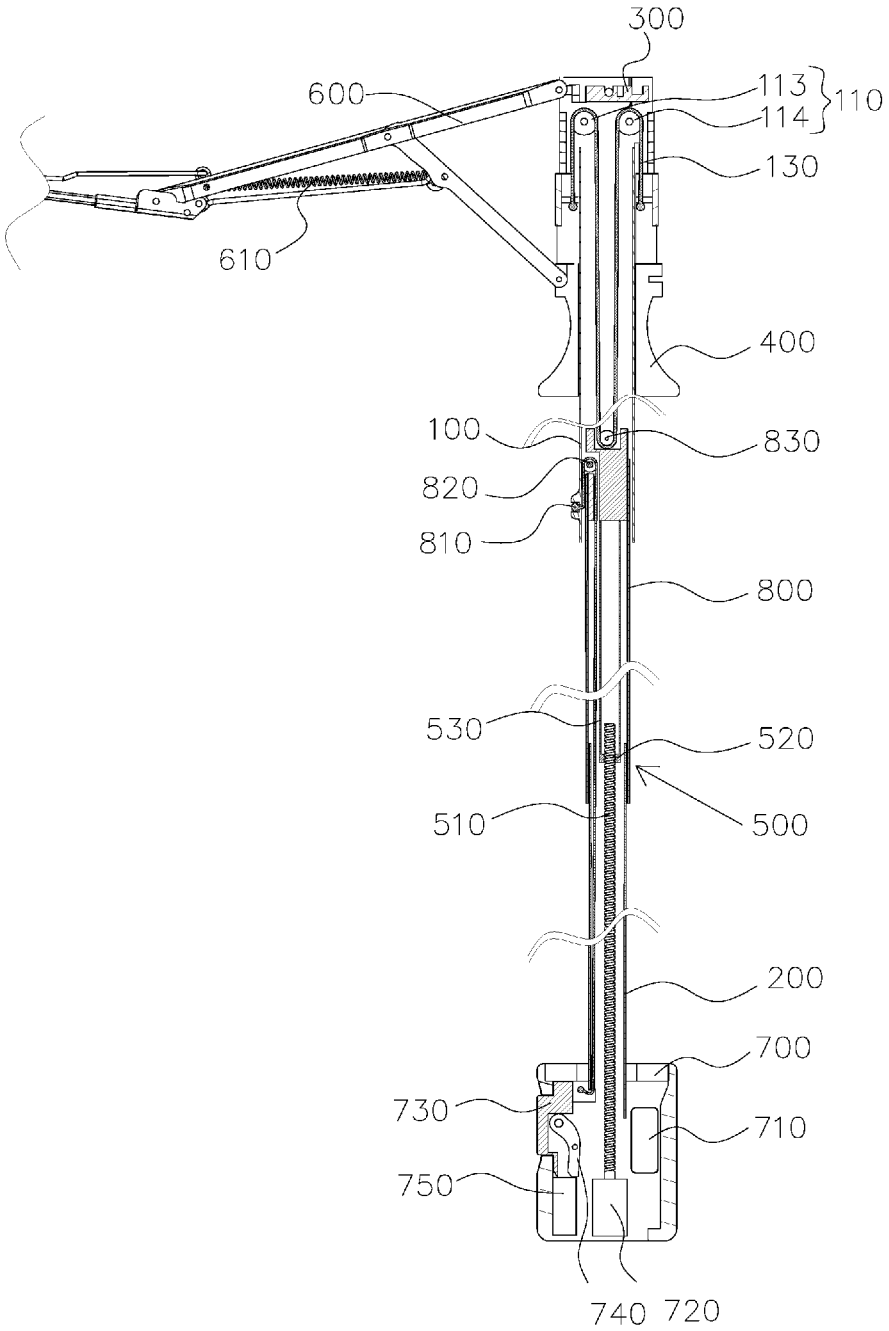
FIG. 1 is a cross sectional view showing the operation of an electric umbrella having roller sets according to a first embodiment of the present invention.
Figure 2:
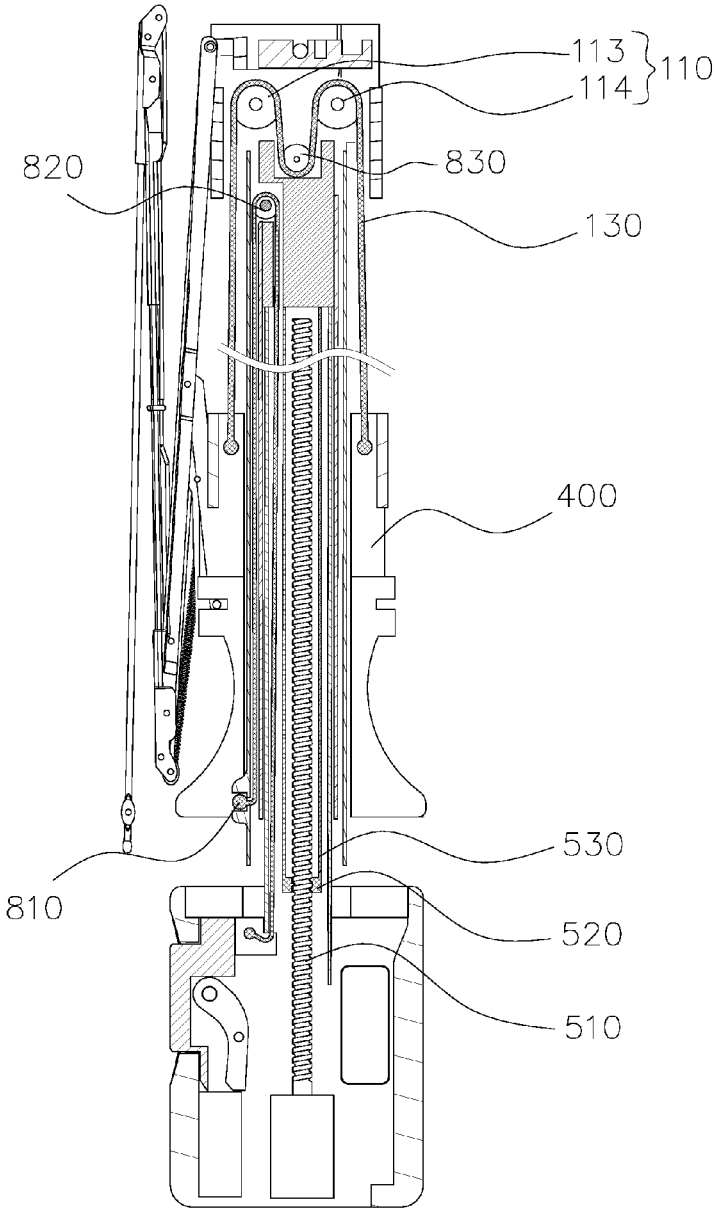
FIG. 2 is another cross sectional view showing the operation of the electric umbrella having roller sets according to first embodiment of the present invention.

With reference to FIGS. 1 and 2, an electric umbrella having roller sets according to a second embodiment of the present invention comprises: a first stick section 100, a second stick section 200, a third stick section 800, and a transmission mechanism 500, wherein the second stick section 200 is fitted in the third stick section 800, the third stick section 800 is fitted in the first stick section 100, a lower portion of the second stick section 200 is in connection with a handle 700. A cross section of the first stick section 100, the second stick section 300, and the third stick section 800 is circular, square, or noncircular. The first stick section 100 includes an upper runner 300 disposed on a top thereof and includes a first roller set 110 mounted therein, wherein the first roller set 110 has two first rollers (i.e., a first roller 113 and a second roller 114) which are parallel to each other. Two ends of the driving rope 130 are fixed on two sides of the lower runner 400, respectively, and the driving rope 130 rolls across the first roller set 110 and slides upwardly and downwardly between a top of the third stick section 800 and the first roller set 110, a third stick section 800 having an fourth roller 830, and the electric umbrella of the third embodiment further comprises a driving rope 130, wherein a first end of the driving rope 130 is fixed on a first side of a lower runner 400, and a second end of the driving rope 130 rolls across the first roller 113 of the first roller set 110, the fourth roller 830, and a second roller 114 to extend out of and connect with a second side of the lower runner 400. The upper runner 300 and the lower runner 400 are in connection with an umbrella skeleton 600. A first end of a pull rope 810 is secured on the handle 700, and a second end of the pull rope 810 extends across a third roller 820 on the top of the third stick section 800 to join with the first stick section 100.

The transmission mechanism 500 is configured to drive the third stick section 800 and is mounted in the second stick section 200. The transmission mechanism 500 includes a threaded rod 510 and an abutting rod 530, wherein the abutting rod 530 has a screw nut 520 engaging with the threaded rod 510, and a bottom of the threaded rod 510 coupes with the handle 700. In addition, the handle 700 has a fixer configured to fix the pull rope 810.

The driving source, mounted in the handle 700, has a power supply 710 and a motor 720, wherein the power supply 710 supplies power to the motor 720. The handle 700 has a button 730 disposed on a peripheral side thereof, a touch switch 750 fixed thereon and electrically connected with the power supply 710, and a pushing piece 740 defined between the button 730 and the touch switch 750, such that the button 730 starts or stops starts a power circuit by using the pushing piece 730 and the touch switch 750. When the button 730 is pressed to force the pushing piece 740, contacts points of the pushing piece 740 contact with the touch switch 750, hence the button 730 starts the power circuit. When releasing the button 730, the pushing piece 740 moves back to its original position and removes from the touch switch 750, hence the button 730 stops starting the power circuit.

The driving source in the handle 700 drives the transmission mechanism 500 to actuate the third stick section 800 to move upwardly and downwardly, and the pull rope 810 is driven by the transmission mechanism 500 to pull the first stick section 100 to move upwardly and downwardly, thus expanding or retracting the umbrella skeleton 600.

Referring to FIG. 1, as desiring to expand the electric umbrella, the button 730 is pressed to start a power circuit, and the motor 720 is driven by the power circuit to drive the threaded rod 510 to rotate in a clockwise direction. Since the threaded rod 510 engages with the screw nut 520, the screw nut 520 moves upwardly with the abutting rod 530, a top of the abutting rod 530 pushes the third stick section 800 and the third roller 820 of the third stick section 800 to move upwardly, and the pull rope 810 pulls the first stick section 100 upwardly. Due to a distance of an upward movement of the third stick section 800 is equal to a distance of an upward movement of the threaded rod 510 and is half of a length of the pull rope 810, a distance of an upward movement of the first roller set 110 is more than the third stick section 800, and the first roller set 130 moves upwardly to pull the driving rope 130 so that a part of the driving rope 130 in the first stick section 100 is stretched, and a connecting portion of the driving rope 130 and the lower runner 400 decreases to pull the lower runner 400 upwardly, thus expanding the umbrella skeleton 600. Thereafter, the button 730 is released to stop starting the power circuit, thus stopping the motor 720.

With reference to FIG. 2, as desiring to retract the electric umbrella, the button 730 is pressed to start the power circuit, and the motor 720 drives the threaded rod 510 to rotate in a counterclockwise direction, wherein the screw nut 520 moves downwardly with the abutting rod 530, and the third stick section 800 moves upwardly because it is not supported by the abutting rod 530. In the meantime, a part of the pull rope 810, connecting with the first stick section 100, moves downwardly with the third roller 820, and the first stick section 100 moves downwardly, wherein a distance of a downward movement of the first stick section 100 is more than a downward movement of the third stick section 800, hence when the first stick section 100 moves downwardly, the first roller set 100 moves downwardly, and the part of the driving rope 130 in the first stick section 100 is reduced so that the connecting portion of the driving rope 130 and the lower runner 400 is prolonged to pull the lower runner 400 downwardly, thus retracting the umbrella skeleton 600. Thereafter, the button 730 is released to stop starting the power circuit, and the motor 720 stops operation.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An electric umbrella having roller sets comprising: a first stick section (100), a second stick section (200), a third stick section (800), and a transmission mechanism (500), the second stick section (200) being fitted in the third stick section (800), and the third stick section (800) being fitted in the first stick section (100), a lower portion of the second stick section (200) being in connection with a handle (700), characterized in that the first stick section (100) includes an upper runner (300) disposed on a top thereof and includes a first roller set (110) disposed therein, and two ends of a driving rope (130) are fixed on two sides of a lower runner (400), respectively, the driving rope (130) rolls across the first roller set (110) and slides upwardly and downwardly between a top of the third stick section (800) and the first roller set (110), the upper runner (300) and the lower runner (400) are connected with an umbrella skeleton (600), a first end of a pull rope (810) is secured on the handle (700), and a second end of the pull rope (810) extends across a third roller (820) on the top of the third stick section (800) to join with the first stick section (100);

the transmission mechanism (500) is accommodated in the second stick section (200) and drives the third stick section (800);

a driving source is mounted in the handle (700) to drive the transmission mechanism (500), and the transmission mechanism (500) drives the umbrella skeleton (600) to expand or retract.

2. The electric umbrella having roller sets as claimed in claim 1, characterized in that the third stick section (800) has an fourth roller (830) across which the driving rope (130) rolls.

3. The electric umbrella of claim 1 having the driving rope (130), wherein a first end of the driving rope (130) is fixed on a first side of a lower runner (400), and a second end of the driving rope (130) rolls across a first roller (113) of a first roller set (110), a fourth roller (830), and a second roller (114) to extend out of and connect with a second side of the lower runner (400).

4. The electric umbrella of claim 2 having the driving rope (130), wherein a first end of the driving rope (130) is fixed on a first side of a lower runner (400), and a second end of the driving rope (130) rolls across a first roller (113) of a first roller set (110), the fourth roller (830) and a second roller (114) to extend out of and connect with a second side of the lower runner (400).

* * * * *